US009072378B2

(12) United States Patent
Baum et al.

(10) Patent No.: US 9,072,378 B2
(45) Date of Patent: Jul. 7, 2015

(54) ADJUSTABLE DRAWER DIVIDER

(71) Applicant: Electrolux Home Products, Inc., Charlotte, NC (US)

(72) Inventors: Christopher Baum, Anderson, SC (US); William Lee Moody, Anderson, SC (US); Caleb Gossens, Charlotte, NC (US); Benjamin Mobley, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 13/705,863

(22) Filed: Dec. 5, 2012

(65) Prior Publication Data

US 2014/0152166 A1 Jun. 5, 2014

(51) Int. Cl.

| | |
|---|---|
| ***A47B 96/04*** | (2006.01) |
| ***A47B 88/20*** | (2006.01) |
| ***F25D 25/02*** | (2006.01) |

(52) U.S. Cl.

CPC ..... *A47B 88/20* (2013.01); *F25D 25/022* (2013.01)

USPC ..... 312/404; 312/348.3; 220/529

(58) Field of Classification Search

USPC ..... 312/401, 404, 402, 348.3; 220/529, 220/530, 532, 533, 534, 538, 539, 535, 536, 220/541, 543, 545, 546, 547, 544

See application file for complete search history.

(56) References Cited

U.S. PATENT DOCUMENTS

| | | | | |
|---|---|---|---|---|
| 5,269,600 | A * | 12/1993 | Arreola et al. | 312/348.3 |
| 5,312,180 | A * | 5/1994 | Tieder et al. | 312/348.3 |
| 5,366,283 | A * | 11/1994 | Crose | 312/183 |
| 6,834,924 | B2 * | 12/2004 | Hollenstein | 312/348.3 |
| 6,991,307 | B2 * | 1/2006 | Hoenig | 312/348.3 |
| 7,296,433 | B2 | 11/2007 | Uihlein et al. | |
| 7,874,176 | B2 | 1/2011 | Uihlein et al. | |
| 8,479,947 | B1 * | 7/2013 | Albrecht, Ii | 220/592.02 |
| 8,511,767 | B2 * | 8/2013 | Haidar et al. | 312/402 |
| 8,590,992 | B2 * | 11/2013 | Lim et al. | 312/404 |
| 8,733,867 | B2 * | 5/2014 | Hwang et al. | 312/402 |
| 8,770,432 | B2 * | 7/2014 | Rueckheim et al. | 220/523 |

(Continued)

FOREIGN PATENT DOCUMENTS

DE 20 2009 012 184 U1 2/2010

OTHER PUBLICATIONS

International Search Report issued in Application No. PCT/US2013/072976 dated Mar. 10, 2014.

(Continued)

*Primary Examiner* — Daniel Rohrhoff
(74) *Attorney, Agent, or Firm* — Pearne & Gordon LLP

(57) ABSTRACT

An assembly comprising a storage receptacle includes a front panel, a rear panel, a first side panel joining the front panel to the rear panel and a second side panel joining the front panel to the rear panel. The front panel, the rear panel and the first and second side panels define a storage space within the confines of the front panel, the rear panel and the first and second side panels. A divider is located within the storage space and extends between the front panel and the rear panel and divides the storage space into storage space sections. A spring operated mechanism engages the divider to selectively maintain the divider in place in the storage space and allows for the position of the divider to be adjusted between the first side panel and the second side panel, whereby the dimensions of the storage space sections can be adjusted.

20 Claims, 3 Drawing Sheets

(56) References Cited

U.S. PATENT DOCUMENTS

| | | | | |
|---|---|---|---|---|
| 8,789,903 | B2 * | 7/2014 | Lim et al. | 312/404 |
| 8,833,881 | B2 * | 9/2014 | Manniso et al. | 312/348.3 |
| 2007/0126326 | A1 * | 6/2007 | O'Halloran et al. | 312/404 |
| 2008/0128428 | A1 * | 6/2008 | Beckerman | 220/532 |
| 2008/0129167 | A1 * | 6/2008 | Rand et al. | 312/330.1 |
| 2008/0272679 | A1 | 11/2008 | Wuesthoff et al. | |
| 2008/0314067 | A1 | 12/2008 | Lee | |
| 2009/0026906 | A1 * | 1/2009 | Kim | 312/401 |
| 2009/0230832 | A1 * | 9/2009 | Shin | 312/404 |
| 2010/0319391 | A1 | 12/2010 | Lim et al. | |
| 2012/0168434 | A1 * | 7/2012 | Alagarda Cervera et al. | 220/4.33 |
| 2013/0099651 | A1 * | 4/2013 | Hwang et al. | 312/404 |

OTHER PUBLICATIONS

Written Opinion issued in Application No. PCT/US2013/072976 dated Mar. 10, 2014.

* cited by examiner

ADJUSTABLE DRAWER DIVIDER

BACKGROUND OF THE INVENTION

1. Field of the Invention

The present invention relates generally to adjustable dividers for dividing the open spaces of storage drawers into open space sections of selected dimensions and, in particular, the invention relates to dividers for storage receptacles located in refrigeration appliances such as household bottom mount refrigerators for example.

2. Discussion of the Prior Art

One or more dividers can be provided within the open spaces of storage drawers for the purpose of dividing the open spaces into open space sections. In certain cases, the dividers can be made adjustable so that the dimensions of the open space sections can be varied to allow for items maintained in the storage drawers to be efficiently organized and stored.

An example of a type of storage drawer that can benefit from the incorporation of one or more adjustable dividers is a storage receptacle or basket that is located within a refrigeration appliance such as a household refrigerator. A storage receptacle of this type can be located in either the fresh food compartment or freezer compartment of a household refrigerator. The storage receptacle typically is slidably supported within the interior of the household refrigerator and can be accessed by pulling open a storage door front that closes off the fresh food and/or freezer compartment in which the storage receptacle is located and withdrawing the storage receptacle, which is attached to the storage door front, from the interior of the household refrigerator. Such arrangements are typically found in the freezer compartments of household bottom mount refrigerators for example.

BRIEF DESCRIPTION OF THE INVENTION

The following description sets forth a simplified summary of examples of the present invention for the purpose of providing a basic understanding of selected aspects of the invention. The summary does not constitute an extensive overview of all the aspects or embodiments of the invention. Neither is the summary intended to identify critical aspects or delineate the scope of the invention. The sole purpose of the summary is to present selected aspects of the invention in a simplified form as an introduction to the more detailed description of the aspects, embodiments and examples of the invention that follows the summary.

According to one aspect of the present invention, an assembly includes a storage receptacle comprising a front panel having a first end and a second end, a rear panel having a first end and a second end, a first side panel joining the first end of the front panel to the first end of the rear panel and a second side panel joining the second end of the front panel to the second end of the rear panel. The front panel, the rear panel, the first side panel and the second side panel are configured to define a storage space within the confines of the front panel, the rear panel, the first side panel and the second side panel. A divider is located within the storage space and extends between the front panel and the rear panel and divides the storage space into storage space sections. A spring operated mechanism is operatively engaged with the divider to selectively maintain the divider in place in the storage space and allow for the positioning of the divider within the storage space to be adjusted between the first side panel and the second side panel, whereby the dimensions of the storage space sections can be adjusted.

According to another aspect of the invention, the divider includes an upper edge, the rear panel includes an upper edge and the spring operated mechanism includes a handle that extends along the upper edge of the divider between a front end of the handle located adjacent the front panel and a rear end of the handle located adjacent the rear panel. The front end of the handle is secured to the divider, and the rear end of the handle rests on the upper edge of the rear panel and is movable along the upper edge of the rear panel.

The assembly, as described in the foregoing aspects, can include a support bar that extends between the first side panel and second side panel adjacent the front panel of the storage receptacle with the front end of the handle being slidably supported at the support bar.

According to an additional aspect, each of the front panel, the rear panel, the first side panel and the second side panel have a bottom edge and the drawer includes a bottom panel joined to each of the front panel, the rear panel, the first side panel and the second side panel at each of the bottom edges of the front panel, the rear panel, the first side panel and the second side panel. The bottom panel closes off at least a substantial portion of the bottom of the storage space. The spring operated mechanism includes a compression spring arrangement located between the handle and the upper edge of the divider urging the divider away from the handle downwardly towards the bottom panel of the storage receptacle.

According to still another aspect, the divider includes a grasping site located adjacent the upper edge of the divider that allows the divider to be grasped and moved towards the handle against the urging of the compression spring arrangement, thereby allowing the location of the divider to be adjusted between the first side panel and the second side panel of the storage receptacle.

According to still a further aspect, the upper edge of the rear panel includes a plurality of alternating upwardly facing projections and recesses and a projecting portion of the divider includes a plurality of alternating downwardly facing projections and recesses arranged so as to mesh with the alternating upwardly facing projections and recesses included at the upper edge of the rear panel when the divider is maintained in place in the storage space of the storage receptacle. The alternately downwardly facing projections at the projecting portion of the divider are raised from the recesses between the alternating upwardly facing projections at the upper edge of the rear panel and pass over the alternately upwardly facing projections at the upper edge of the rear panel when the position of the divider is adjusted in the storage space of the storage receptacle.

According to yet another aspect, the front end of the handle is secured to the divider by means of a securing device that requires the application of a tool in order to release the front end of the handle from the divider.

With respect to all the foregoing aspects, the storage receptacle can comprise a basket in the freezer compartment of a household bottom mount refrigerator.

BRIEF DESCRIPTION OF THE DRAWINGS

The foregoing and other aspects of the present invention will be apparent to those skilled in the art to which the present invention relates from the detailed descriptions of aspects, embodiments and examples of the invention that follow with reference to the accompanying drawings, wherein the same reference numerals are used in the several figures to refer to the same parts or elements and in which.

DETAILED DESCRIPTION

Examples and embodiments of the invention that incorporate one or more aspects of the present invention are described below with references, in certain respects, to the accompanying drawings. These examples and embodiments are not intended to be limitations on the present invention. Thus, for example, in some instances, one or more examples or embodiments of the present invention described with reference to one aspect, embodiment or example can be utilized in other aspects, embodiments and examples. In addition, certain terminology is used herein for convenience only and is not to be taken as limiting the present invention. In addition, the invention is described below with reference to the application of the invention to a household bottom mount refrigerator. However, the employment of the invention in other applications will be obvious to those skilled in the art.

Figure 1:
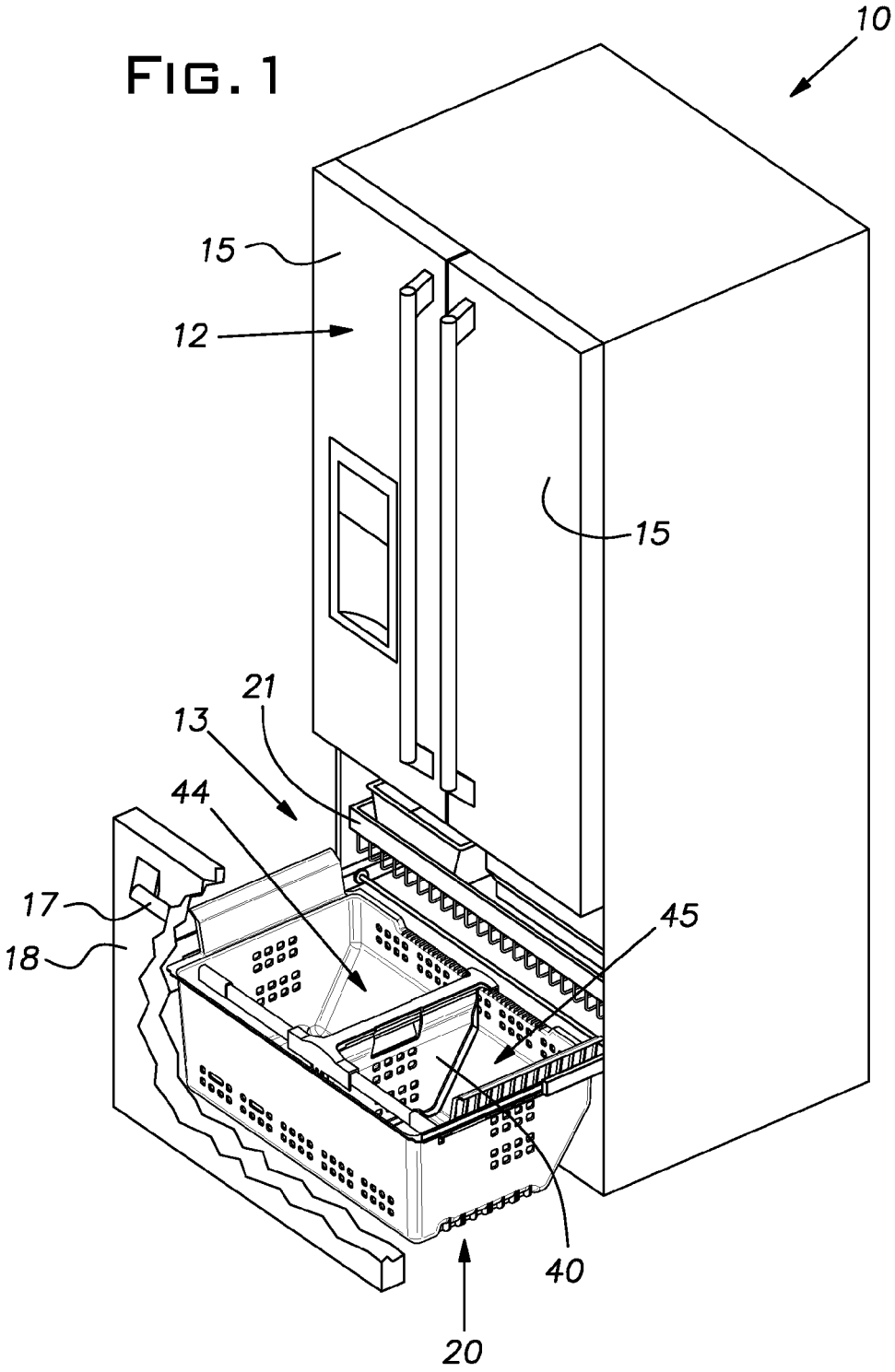
FIG. 1 is a perspective view of a household bottom mount refrigerator shown with the freezer compartment door front pulled open and cut away so as to expose a storage receptacle contained within the freezer compartment, the storage receptacle including a divider in accordance with an aspect of the invention.

FIG. 1 of the accompanying drawings illustrates somewhat schematically a bottom-mount household refrigerator 10. The refrigerator includes a fresh food compartment, indicated generally at 12, arranged above a freezer compartment, indicated generally at 13. In the embodiment of FIG. 1, the fresh food compartment 12 is closed off by and access to the interior of the fresh food compartment is had through side-by-side doors 15-15 as is familiar to those having ordinary skill in the art. The freezer compartment 13, on the other hand, comprises, generally speaking, a pull-out drawer. That is, in order to access the interior of the freezer compartment 13, the user simply pulls outwardly on the handle 17 that is mounted on a drawer front 18 and is operatively associated with a slide or roller arrangement for example, as is familiar to those having ordinary skill in the art, so that the drawer front 18 can proceed outwardly away from the interior of the freezer compartment 13.

A storage receptacle, indicated generally at 20 and sometimes referred to as a basket, is attached to the inside of the drawer front 18 and is transported from within to outside the freezer compartment 13 as the drawer front 18 is pulled outwardly and moves away from the interior of the freezer compartment 13, thereby providing access to items stored in the storage receptacle 20. Located above the storage receptacle 20 is a second receptacle or basket 21 that is not attached to the drawer front 18 but that is also operatively associated with a slide or roller arrangement for example and can be separately pulled outwardly from the freezer compartment interior so that items stored in the second receptacle or basket 21 can be accessed by a user.

Figure 2:
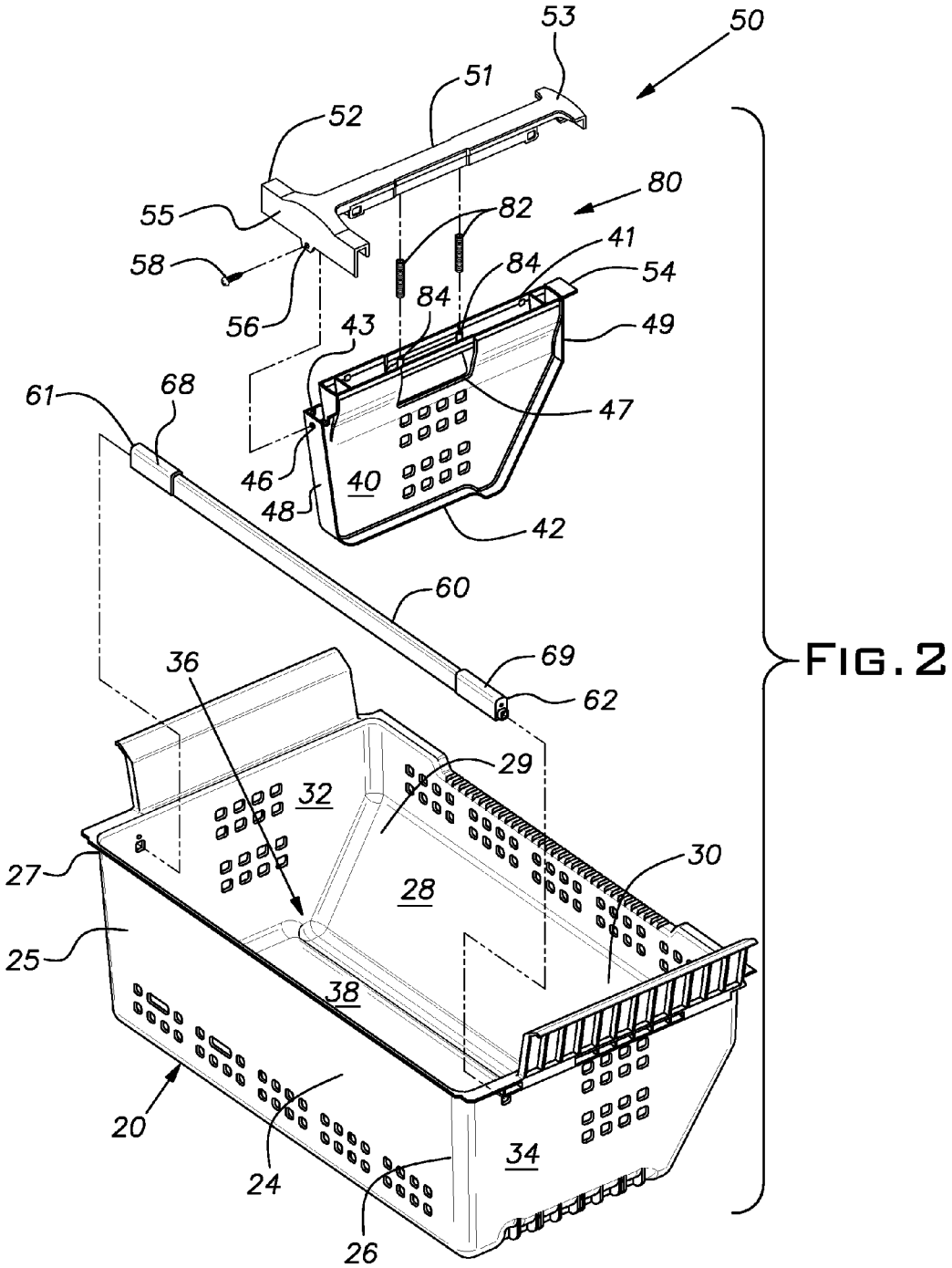
FIG. 2 is an exploded view of the storage receptacle, including the divider, shown in FIG. 1.

For the purpose of better illustrating an aspect of an assembly of the invention, the assembly is shown in FIG. 2 as removed from the freezer compartment 13 and from its attachment to the inside of the drawer front 18. As shown in FIG. 2, the assembly includes the storage receptacle 20, and included in the storage receptacle 20 are: a front panel 24 including a front panel first end 25 and a front panel second end 26; a rear panel 28 including a rear panel first end 29 and a rear panel second end 30; a first side panel 32 joining the first end 25 of the front panel 24 to the first end 29 of the rear panel 28; and a second side panel 34 joining the second end 26 of the front panel 24 to the second end 30 of the rear panel 28. The front panel 24, the rear panel 28, the first side panel 32 and the second side panel 34 are configured to define a storage space, indicated generally at 36, within the confines of the front panel 24, the rear panel 28, the first side panel 32 and the second side panel 34.

Each of the front panel 24, the rear panel 28, the first side panel 32 and the second side panel 34 has a bottom edge and the storage receptacle 20 includes a bottom panel 38 joined to the front panel 24, the rear panel 28, the first side panel 32 and the second side panel 34 at each of the bottom edges of the front panel 24, the rear panel 28, the first side panel 32 and the second side panel 34. The bottom panel 38 closes off at least a substantial portion of the bottom of the storage space 36.

The assembly of the invention shown in FIG. 2 also includes a divider 40 located within the storage space 36. The divider includes an upper edge 41 and a bottom edge 42 and extends between the front panel 24 and the rear panel 28 in a generally vertical attitude and divides the storage space 36 into storage space sections 44 and 45 as best seen in FIG. 1. A grasping site 47, in the form of an opening in the divider 40 in the example shown in the drawings, into which a user's hand can be placed, is located adjacent the upper edge 41 of the divider 40. The grasping site 47 allows the divider 40 to be grasped by a user and the divider to be adjusted laterally within the storage space 36 between the first side panel 32 and the second side panel 34 of the storage receptacle 20 as described in greater detail below.

Also included in the aspect of the assembly of the invention shown in FIG. 2 is a spring operated mechanism, indicated generally at 50, operatively engaged with the divider 40 to selectively maintain the divider 40 in place in the storage space 36 and allow for the position of the divider 40 within the storage space 36 to be adjusted between the first side panel 32 and the second side panel 34, whereby the dimensions of the storage space sections 44 and 45 can be adjusted. The spring operated mechanism 50 includes a handle 51 that that is operatively connected to and extends along the upper edge 41 of the divider 40 between a forward end 52 of the handle 51 that is located adjacent the front panel 24 when the divider 40 and the handle 51 are in place in the storage receptacle 20 and a rearward end 53 of the handle 51 that is located at the rear panel 28 of the storage receptacle 20 when the divider 40 and handle 51 are in place in the storage receptacle 20.

Figure 3:
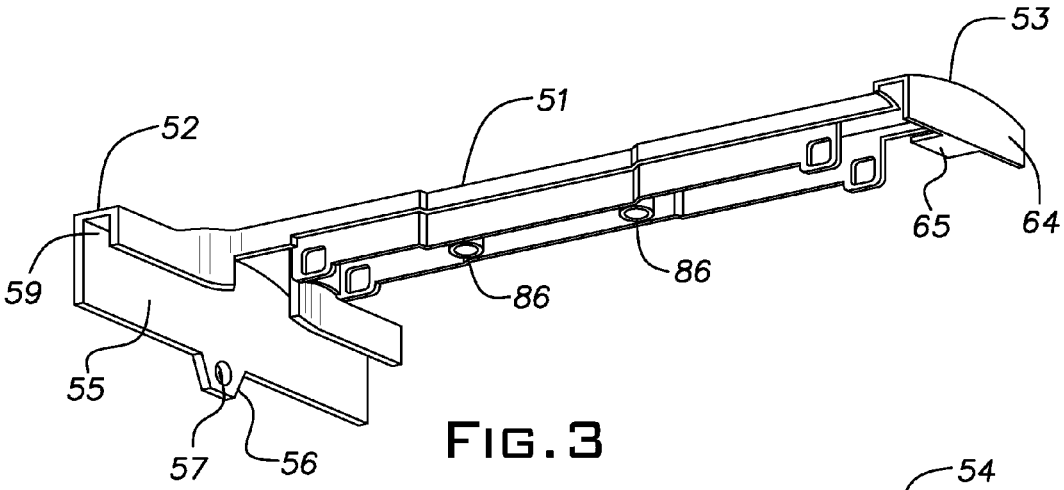
FIG. 3 is an isometric view of a handle of a spring operated mechanism operatively engaged with the divider shown in FIGS. 1 and 2 to selectively maintain the divider in place in the storage receptacle shown in FIGS. 1 and 2 and allow the divider to be repositioned in the storage receptacle.
Figure 5:
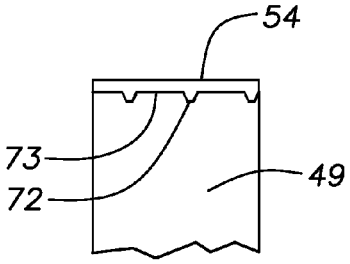
FIG. 5 is a partial rear elevational view of the divider shown in FIGS. 1 and 2 that illustrates certain details of the divider.

The forward end 52 of the handle 51 includes a downwardly extending portion 55, including a projection 56 that is provided with a screwhole 57 as best seen in FIG. 3. The projection 56 extends into a recess 43 at a front end 48 of the divider 40 that is located at the front panel 24 of the storage receptacle 20 when the divider 40 is in place in the storage receptacle. The front end 48 of the divider 40 includes a throughhole 46 that opens into the recess 43 and through which a screw 58 is inserted and fastened at screwhole 57 so as to secure the forward end 52 of the handle 51 to the front end 48 of the divider 40. Other types of fasteners can be employed to secure the forward end 52 of the handle 51 to the front end 48 of the divider.

A support bar 60 at a first support bar end 61 is secured to the first side panel 32 and at a second support bar end 62 to the second side panel 34 in a manner so that the support bar extends between the first side panel 32 and the second side panel 34 adjacent the front panel 24 of the storage receptacle 20. The ends of the support bar 60 can be secured to the first side panel 32 and the second side panel 34 by a screw or any other type of fastener that is preferably removable only by the application of a suitable tool. The forward end 52 of the handle 51 includes a channel 59, as best seen in FIG. 3, at which the forward end of the handle rests on the support bar 60 and is slidably supported. The forward end 48 of the divider 40 also is supported by the support bar 60 as a consequence of the forward end 48 of the divider 40 being fastened to the forward end 52 of the handle through the instrumentality of the screw 58.

The support bar 60, in addition to functioning as a support for the forward end 52 of the handle 51 can function as an aid to the storage of items in the storage receptacle 20. Thus, rather large flat items can be arranged vertically between the front panel 24 and the support bar 60 and conveniently stored. However, the support bar 60 can be eliminated in which case the forward end 52 of the handle 51 and/or the front end 48 of the divider 40 itself can be supported at and slide along the top edge 27 of the front panel 24 when the position of the divider 40 is adjusted.

Figure 4:
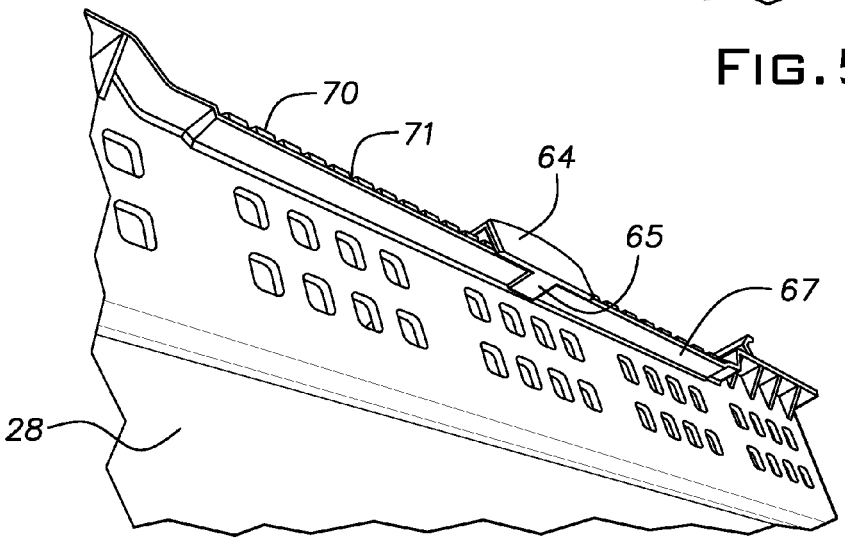
FIG. 4 is an isometric view of rear portions of the storage receptacle shown in FIGS. 1 and 2 and a portion of the handle shown in FIG. 3 that illustrates a relationship between the two.

As best seen in FIG. 3, the rearward end 53 of the handle 51 includes a downwardly extending portion 64 from which a laterally extending tab 65 projects inwardly toward the rear panel 28 of the storage receptacle 20. As best seen in FIG. 4, the tab 65 fits beneath a rear panel overhang 67 that forms the upper edge of the rear panel 28 of the storage receptacle 20 and holds the rearward end 53 of the handle 51 in place at the rear panel overhang 67. The downwardly extending portion 64 and the laterally extending tab 65 at the rearward end 53 of the handle act to hold a rear end 49 of the divider 40 in place at the rear panel 28. More specifically, the divider 40 includes at its rear end 49 a projecting portion 54 that rests on the rear panel overhang 67 of the rear panel 28. The rear panel overhang 67 includes at its upper surface a series of alternating upwardly facing projections 70 and recesses 71 in somewhat of a sawtooth arrangement. The projecting portion 54 of the divider 40 includes a series of alternating downwardly facing projections 72 and downwardly facing recesses 73 arranged so as to mesh with the alternating upwardly facing projections 70 and upwardly facing recesses 71.

The spring operated mechanism 50 also includes a compression spring arrangement, indicated generally at 80, that is located between the handle 51 and the upper edge 41 of the divider 40. In the illustrated embodiment, the compression spring arrangement includes two compression springs 82 that are located between the handle 51 and the divider 40. However, more or fewer compression springs can be provided. One end of each compression spring 82 is positioned over a respective cylindrical peg 84 provided in a recess in the upper edge 41 of the divider 40, and the other end of each compression spring is contained within an open cylinder 86 provided in a recess in the handle 51 as best seen in FIG. 3.

The compression springs 82 tend to force the handle 51 and the divider 40 apart causing the laterally extending tab 65 of the handle to tightly engage the underside of the rear panel overhang 67 so that the alternating downwardly facing projections 72 and downwardly facing recesses 73 of the laterally extending tab 65 and the projections 70 and recesses 71 of the rear panel overhang 67 will be in a good meshing relationship holding the rearward end 53 of the handle 51 in place at the rear panel overhang 67. At the same time, the joining of the forward end 52 of the handle 51 to the divider 40 by means of the screw 58 will prevent the forward end of the handle from separating from the divider and the front end 48 of the divider 40 and the forward end 52 of the handle 51 will be held in place vertically by the support bar 60 passing through the channel 59 of the handle 51. In this relationship, the divider 40 is secured in a selected position in the storage receptacle 20.

With the forward end 52 of the handle fastened to the front end 48 of the divider 40 by means of the screw 58 and the projecting portion 54 of the divider 40 in place at the rear panel overhang 67 and being held there by the instrumentality of the laterally extending tab 65 as it tightly engages the underside of the rear panel overhang 67, the compression springs 82 will tend to urge the divider 40 downwardly. In the illustrated embodiment, the height of the diver 40 is not such that the urging of the divider downwardly causes the bottom edge 42 of the divider to forcefully engage the bottom panel 38 of the storage receptacle 20. However, the bottom edge 42 of the divider 40 can lightly contact the bottom panel 38. Alternatively, the bottom edge 42 of the divider can be essentially entirely out of contact with the bottom panel 38.

The divider can be repositioned in the storage receptacle 20 by the user inserting her fingers through the opening at the grasping site 47 and with the palm of her hand squeezing the handle 51 and the divider 40 together causing the divider 40 to be moved towards the handle 51 against the urging of the compression spring arrangement 80. As a result, the laterally extending tab 65 becomes disengaged from the underside of the rear panel overhang 67. Sufficient looseness is created at the meshing of the downwardly facing projections 72 and downwardly facing recesses 73 of the laterally extending tab 65 with the upwardly facing projections 70 and upwardly facing recesses 71 at the rear panel overhang 67, even though they may not be entirely disengaged, to allow the projecting portion 54 of the divider 40 to move over the rear panel overhang 67 as the divider is relocated within the storage receptacle 20. At the same time, the front end 52 of the handle 51 will slide along the support bar 60 in whichever direction the divider is moved. Once the divider 40 is relocated, it can be once again fixed in place by the user simply releasing the squeezing pressure being applied to the handle 51 and the divider 40 at the grasping site 47.

A safety feature of the assembly of the invention is that the divider 40 and the support bar 60 can only be removed from the storage receptacle 20 by the application of a tool. In the described embodiment, of course, the tool would comprise a screwdriver for removing the screw 58 holding the front end 52 of the handle 51 to the divider 40 and the screws that hold the support bar ends 61 and 62 to the first side panel 32 and the second side panel 34, respectively. Depending on the type of fastener used, other types of tools may be more suitable. The necessity of providing a tool reduces the likelihood that the divider and the support bar can be easily removed from the storage receptacle 20 so as to allow a small child, for example, to crawl into the storage receptacle and have the door 18 of the freezer compartment 13 closed while the child remained in the storage receptacle at the grasping site 47.

An additional safety feature of the embodiment of the invention shown in the drawings comprises the enlargements 68 and 69 that are present adjacent opposite ends of the support bar 60. These enlargements prevent the handle 51 from sliding to the ends of the support bar 60 along the channel 59 of the handle 51. As a result, the likelihood that the divider 40 might be relocated so near one or the other of the ends of the support bar 60 as to provide adequate space in the storage receptacle 20 for a small child, for example, to crawl into the storage receptacle is reduced.

While the present invention has been described above and illustrated with reference to certain embodiments thereof, it is to be understood that the invention is not so limited. In addition, modifications and alterations of the aspects of the invention described herein will occur to those skilled in the art upon reading and understanding the specification, including the drawings. The present invention is intended to cover and include any and all such modifications and variations to the described embodiments that are encompassed by the following claims.

What is claimed is:

1. An assembly comprising:

a storage receptacle including a first panel having a first end and a second end, a second panel having a first end and a second end, a third panel joining the first end of the first panel to the first end of the second panel and a fourth panel joining the second end of the first panel to the second end of the second panel; wherein the first panel, the second panel, the third panel, and the fourth panel are configured to define a storage space within the confines of the first panel, the second panel, the third panel, and the fourth panel;

a divider located within the storage space and extending between the first panel and the second panel and dividing the storage space into storage space sections; and a spring operated mechanism operatively engaged with the divider to selectively maintain the divider in place in the storage space and allow for positioning of the divider within the storage space to be adjusted between the third panel and the fourth panel, whereby dimensions of the storage space sections can be adjusted, and wherein the divider includes an upper edge, the second panel includes an upper edge and the spring operated mechanism includes a handle that extends along the upper edge of the divider between a first end of the handle located adjacent the first panel and a second end of the handle located at the second panel, the first end of the handle being secured to the divider, and the second end of the handle being movable along the upper edge of the second panel, and wherein the divider is moveable relative to the second end of the handle.

2. The assembly of claim 1 wherein the storage receptacle comprises a basket in a freezer compartment of a household bottom mount refrigerator.

3. The assembly of claim 1 including a support bar extending between the third panel and the fourth panel adjacent the first panel of the storage receptacle, the first end of the handle being slidably supported at the support bar.

4. The assembly of claim 3 wherein the storage receptacle comprises a basket in a freezer compartment of a household bottom mount refrigerator.

5. The assembly of claim 3 wherein each of the first panel, the second panel, the third panel, and the fourth panel has a bottom edge and the storage receptacle includes a fifth panel joined to each of the first panel, the second panel, the third panel, and the fourth panel at each of the bottom edges of the first panel, the second panel, the third panel, and the fourth panel and at least substantially closing off the bottom of the storage space, and the spring operated mechanism includes a compression spring arrangement located between the handle and the upper edge of the divider urging the handle and the divider away from one another.

6. The assembly of claim 5 wherein the storage receptacle comprises a basket in a freezer compartment of a household bottom mount refrigerator.

7. The assembly of claim 5 wherein the divider includes a grasping site located adjacent the upper edge of the divider that allows the divider to be grasped and moved towards the handle against the urging of the compression spring arrangement, thereby allowing the divider to be adjusted between the third panel and the fourth panel of the storage receptacle.

8. The assembly of claim 7 wherein the storage receptacle comprises a basket in a freezer compartment of a household bottom mount refrigerator.

9. The assembly of claim 7 wherein the upper edge of the second panel includes a plurality of alternating upwardly facing projections and recesses and a projecting portion of the divider includes a plurality of alternating downwardly facing projections and recesses arranged so as to be in a good meshing relationship with the alternating upwardly facing projections and recesses included at the upper edge of the second panel when the divider is maintained in place in the storage space of the storage receptacle, and the alternating downwardly facing projections at the projecting portion of the divider are disengaged from the good meshing relationship with the recesses between the alternating upwardly facing projections at the upper edge of the second panel so that the downwardly facing projections can pass over the alternately upwardly facing projections at the upper edge of the second panel when the divider is grasped and moved towards the handle, whereby a position of the divider can be adjusted in the storage space of the storage receptacle.

10. The assembly of claim 9 wherein the storage receptacle comprises a basket in a freezer compartment of a household bottom mount refrigerator.

11. The assembly of claim 10 wherein the first end of the handle is secured to the divider by means of a securing device that requires an application of a tool in order to release the first end of the handle from the divider.

12. The assembly of claim 1 wherein, the divider is moveable relative to the second end of the handle in a direction against a biasing force of the spring operated mechanism.

13. The assembly of claim 12, wherein the upper edge of the second panel includes a panel overhang including a first surface against which a projecting portion of the divider contacts and a second surface against which the second end of the handle contacts.

14. The assembly of claim 13, wherein the second end of the handle includes a downwardly extending portion and a laterally extending tab, wherein the laterally extending tab contacts the second surface of the panel overhang, and wherein the second surface is arranged on an underneath side of the panel overhang opposite the first surface.

15. The assembly of claim 13, wherein the biasing force of the spring operated mechanism biases the divider and the handle in opposite directions, wherein the contact of the projecting portion of the divider with the first surface of the panel overhang opposes the biasing of the divider, and wherein the contact of the second end of the handle with the second surface of the panel overhang opposes the biasing of the handle.

16. The assembly of claim 13, wherein the biasing force causes the projecting portion of the divider to contact the first surface of the panel overhang and the second end of the handle to contact the second surface of the panel overhang.

17. The assembly of claim 16, wherein, when the divider is moved relative to the second end of the handle against the biasing force of the spring operated mechanism, the projecting portion of the divider is removed from contacting the first surface of the panel overhang.

18. An assembly comprising:

a storage receptacle including a first panel having a first end and a second end, a second panel having a first end and a second end, a third panel joining the first end of the first panel to the first end of the second panel and a fourth panel joining the second end of the first panel to the second end of the second panel; wherein the first panel, the second panel, the third panel, and the fourth panel are configured to define a storage space within the confines of the first panel, the second panel, the third panel, and the fourth panel;

a divider located within the storage space and extending between the first panel and the second panel and dividing the storage space into storage space sections; and a spring operated mechanism operatively engaged with the divider to selectively maintain the divider in place in the storage space and allow for positioning of the divider within the storage space to be adjusted between the third panel and the fourth panel, whereby dimensions of the storage space sections can be adjusted, and wherein the divider includes an upper edge, the second panel includes an upper edge and the spring operated mechanism includes a handle that extends along the upper edge of the divider between a first end of the handle located adjacent the first panel and a second end of the handle located at the second panel, the first end of the handle being secured to the divider, and the second end of the handle being movable along the upper edge of the second panel; the assembly further comprising a support bar extending between the third panel and the fourth panel adjacent the first panel of the storage receptacle, the first end of the handle being slidably supported at the support bar, wherein each of the first panel, the second panel, the third panel, and the fourth panel has a bottom edge and the storage receptacle includes a fifth panel joined to each of the first panel, the second panel, the third panel, and the fourth panel at each of the bottom edges of the first panel, the second panel, the third panel, and the fourth panel and at least substantially closing off the bottom of the storage space, and the spring operated mechanism includes a compression spring arrangement located between the handle and the upper edge of the divider urging the handle and the divider away from one another, wherein the divider includes a grasping site located adjacent the upper edge of the divider that allows the divider to be grasped and moved towards the handle against the urging of the compression spring arrangement, thereby allowing the divider to be adjusted between the third panel and the fourth panel of the storage receptacle, and wherein the upper edge of the second panel includes a plurality of alternating upwardly facing projections and recesses and a projecting portion of the divider includes a plurality of alternating downwardly facing projections and recesses arranged so as to be in a good meshing relationship with the alternating upwardly facing projections and recesses included at the upper edge of the second panel when the divider is maintained in place in the storage space of the storage receptacle, and the alternating downwardly facing projections at the projecting portion of the divider are disengaged from the good meshing relationship with the recesses between the alternating upwardly facing projections at the upper edge of the second panel so that the downwardly facing projections can pass over the alternately upwardly facing projections at the upper edge of the second panel when the divider is grasped and moved towards the handle, whereby a position of the divider can be adjusted in the storage space of the storage receptacle.

19. The assembly of claim 18 wherein the storage receptacle comprises a basket in a freezer compartment of a household bottom mount refrigerator.

20. The assembly of claim 19 wherein the first end of the handle is secured to the divider by means of a securing device that requires an application of a tool in order to release the first end of the handle from the divider.

* * * * *